United States Patent [19]

Herget et al.

[11] 4,382,061

[45] May 3, 1983

[54] ALLOY PREPARATION FOR PERMANENT MAGNETS

[75] Inventors: Camillo Herget; Hans-Günter Domazer, both of Essen; Mircea Velicescu, Bochum, all of Fed. Rep. of Germany

[73] Assignee: Th. Goldschmidt AG, Fed. Rep. of Germany

[21] Appl. No.: 290,248

[22] Filed: Aug. 5, 1981

[30] Foreign Application Priority Data

Oct. 25, 1980 [DE] Fed. Rep. of Germany ..... 3040342

[51] Int. Cl.[3] ..... C22C 19/00

[52] U.S. Cl. ..... 420/435; 148/31.57; 148/425; 420/416

[58] Field of Search ..... 75/171, 170, 152; 148/31.55, 31.57, 408, 425; 420/416, 435

[56] References Cited

U.S. PATENT DOCUMENTS

| | | | |
|---|---|---|---|
| 3,546,030 | 12/1970 | Buschow et al. | 148/31.57 |
| 3,615,911 | 10/1971 | Nesbitt et al. | 75/170 |
| 3,682,714 | 8/1972 | Martin | 148/31.57 |
| 3,682,715 | 8/1972 | Martin | 148/31.57 |
| 3,682,716 | 8/1972 | Martin et al. | 75/170 |
| 3,684,591 | 8/1972 | Martin | 148/31.57 |
| 3,873,379 | 3/1975 | Yamakawa et al. | 148/31.57 |
| 4,087,291 | 5/1978 | Gaiffi et al. | 148/31.57 |
| 4,090,892 | 5/1978 | Klein et al. | 148/31.57 |
| 4,131,495 | 12/1978 | Menth et al. | 75/170 |
| 4,144,105 | 3/1979 | Gaiffi et al. | 148/31.57 |
| 4,192,696 | 3/1980 | Menth et al. | 75/152 |

*Primary Examiner*—John P. Sheehan

*Attorney, Agent, or Firm*—James E. Bryan

[57] ABSTRACT

This invention relates to an alloy suitable for the production of permanent magnets and based on a cobalt-/rare earth metal alloy in the atomic ratio of 5:1 to 7:2, where the rare earth metal component is composed of about 40 to 60 atomic percent of samarium, about 15 to 30 atomic percent of lanthanum, about 15 to 30 atomic percent of neodymium, and the remainder is a content of other rare earth metals resulting from preparation.

1 Claim, No Drawings

ALLOY PREPARATION FOR PERMANENT MAGNETS

The invention relates to the preparation of an alloy for making permanent magnets based on a cobalt/rare earth metal alloy in the atomic ratio of 5:1 to 7:2, where the rare earth metal component is composed of at least three different rare earth metals.

German Offenlegungsschrift No. 1,558,550 discloses a permanent magnet consisting of fine, permanently magnetic particles and of which the substantial component is $M_5R$, where M=Co or a combination of Co with one or more of the elements Fe, Ni, and Cu, and where R=La or Th, or a combination of Th with one or more of the elements of the rare earths, or a combination of at least three elements of the rare earths. The Offenlegungsschrift points out that the permanent magnet consisting of these alloys should be homogenized at a temperature as close as possible to and below the melting point in an atmosphere protective against oxidation, in order to form the desired compounds.

German Auslegeschrift No. 2,142,368 discloses using sintered intermetallic cobalt and samarium compounds for permanent magnets, the sintered intermetallic compounds having the following composition:

(a) 36 to 39% of samarium and praseodymium for a cobalt content of 61 to 64%, where the praseodymium content is between 10 and 90% of the rare earth metal content, or (b) 34 to 39% of samarium and lanthanum for a cobalt content of 61 to 66%, where the lanthanum content is from 10 to 90% of the rare earth metal content, or (c) 34 to 40% of samarium and cerium for a cobalt content of 60 to 66%, where the cerium content is between 10 and 90% of the rare earth metal content, or (d) 34 to 39% of samarium and cerium misch metal for a cobalt content of 61 to 66%, where the cerium misch metal content is between 10 and 90% of the rare earth metal content.

A dependent claim refers to the fact that lanthanum is replaced by a rare earth metal consisting of cerium, neodymium, praseodymium, yttrium and mixtures of the metals in an amount such that lanthanum remains present in a proportion of at least 10% of the rare earth metal content.

This Auslegeschrift also discloses that the properties of a permanent magnet made from a sintered intermetallic compound can be further improved by heat-aging the permanent magnet at a temperature of 400° C. below the temperature of sintering for 24 hours in a neutral atmosphere.

A number of further publications reveal to the expert how to anneal alloys of cobalt/rare earth metals of the above alloy types for the purpose of achieving optimal properties.

However, this annealing stage requires a high cost in time because annealing ordinarily is carried out over a span of several hours. Moreover, the energy consumption is substantial, as a temperature of about 800° to 900° C. must be maintained during annealing.

It is the object of the present invention to provide alloys of cobalt/rare earth metals which do not require this annealing, and which nevertheless possess properties that otherwise can be obtained only by annealing.

Surprisingly, it was discovered that cobalt/rare earth metal alloys with an atomic ratio of 5:1 to 7:2 do not require annealing provided the rare earth metal component is composed of:

40 to 60 atomic percent of samarium,
15 to 30 atomic percent of lanthanum, and
15 to 30 atomic percent of neodymium.

The remainder is a content of other rare earth metals resulting from preparation.

This unusual content of the alloys of the invention was completely surprising to the expert and is disclosed by no publication.

As regards the practical use of these cobalt/rare earth metal alloys as permanent magnets, this means a substantial simplification of the production process together with reductions in time and energy costs. Thereby, it becomes possible to manufacture these alloys at a relatively low price, and hence to make them accessible to wider applications. It is especially valuable that the rare earth components lanthanum and neodymium belong to the rare earths which are relatively common in nature, and that accordingly no difficulties arise concerning the availability of the alloy components.

The magnetic properties of cobalt/rare earth metal magnets of the invention, of the compound type $$(Sm, La, Nd)Co_5,$$

are compared in Table I with similar magnets which are no part of the invention. The alloys 1, 2, 6, and 7, are no part of the invention and are contrasted with the alloys 3, 4, and 5, which are part of the invention.

TABLE I

| | | not of the invention | | of the invention | | | | | not of the invention | |
|---|---|---|---|---|---|---|---|---|---|---|
| | | 1 | 2 | 3* | 3** | 4* | 4** | 5 | 6 | 7 |
| Sm | | 0.53 | 0.53 | 0.53 | | 0.53 | | 0.60 | 0.6 | 0.4 |
| La | | 0.06 | 0.10 | 0.15 | | 0.18 | | 0.15 | — | — |
| Nd | | 0.29 | 0.26 | 0.21 | | 0.18 | | 0.24 | 0.4 | 0.6 |
| other rare earths | | 0.11 | 0.11 | 0.11 | | 0.11 | | — | — | — |
| $B_R$ | mT | 840 | 860 | 900 | 900 | 900 | 900 | 880 | 1000 | 1020 |
| $_JH_C$ | kA/m | 776 | 830 | 1200 | 600 | 1160 | 620 | 1200 | 400 | 40 |
| $H_K$ | kA/m | 330 | 360 | 1120 | 320 | 1040 | 350 | 800 | 320 | — |
| $BH_{max}$ | $kJ/m^3$ | 120 | 132 | 160 | 144 | 160 | 140 | 136 | 140 | — |

$B_R$ is the alloy remanence,
$_JH_C$ is the coercive field strength of the polarization,
$H_K$ is the so-called kneefield and provides information to the expert about the squareness of the demagnetization curve, and
$BH_{max}$ denotes the energy product.

Because of the low lanthanum content, alloys 1 and 2 are outside the scope of the invention. Also, they possess a low coercive field strength.

The alloy 3* is of the composition of the invention and without annealing evinces a remanence of 900 mT.

The coercive field strength is 1200 kA/m. The kneefield is 1120 kA/m, and the energy product is 160 kJ/m$^3$.

When this alloy is annealed for 3 hours at 890° C., the alloy 3** is obtained, which evinces appreciably reduced values for the coercive field strength, the kneefield and the energy product.

The same situation applies to the alloy 4* of the invention. The non-annealed alloy again evinces a coercive field strength of 1160 kA/m, a kneefield of 1040 kA/m and an energy product of about 160 kJ/m$^3$. The alloy 4** annealed at 870° C. for 4 hours evinces a clear drop in the coercive field strength to 620 kA/m, of the kneefield to about 350 kA/m, and of the energy product to about 140 kJ/m$^3$.

The alloy 5, also of the invention, is still within the boundary of the invention as regards the samarium and lanthanum content. The alloy still evinces a high coercive field strength, the remanence has dropped slightly to 880 mT, but the kneefield already is at 800 kA/m.

Even after an optimizing sintering treatment, the alloys 6 and 7, which are not part of the invention, evince wholly insufficient coercive field strengths and an inadequate kneefield.

Hence the table shows that the alloys of the invention evince a behavior deviating in an unexpected manner from the norm but in a very advantageous manner.

It will be obvious to those skilled in the art that many modifications may be made within the scope of the present invention without departing from the spirit thereof, and the invention includes all such modifications.

What we claim is:

1. A cobalt/rare earth metal alloy in the atomic ratio of 5:1 to 7:2, and being suitable for the production of permanent magnets, where the rare earth metal component is composed of about 40 to 60 atomic percent of samarium, about 15 to 30 atomic percent of lanthanum, about 15 to 30 atomic percent of neodymium, and the remainder is a content of other rare earth metals resulting from preparation.

* * * * *